US011200838B2

(12) United States Patent
Qu et al.

(10) Patent No.: US 11,200,838 B2
(45) Date of Patent: Dec. 14, 2021

(54) AGING DEVICE AND AGING METHOD

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Jiawei Qu, Beijing (CN); Wenjun Liao, Beijing (CN); Da Zhou, Beijing (CN); Taoran Zhang, Beijing (CN); Linxuan Li, Beijing (CN); Ke Dai, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 568 days.

(21) Appl. No.: 16/092,622

(22) PCT Filed: Apr. 18, 2018

(86) PCT No.: PCT/CN2018/083546

§ 371 (c)(1),
(2) Date: Oct. 10, 2018

(87) PCT Pub. No.: WO2019/037451

PCT Pub. Date: Feb. 28, 2019

(65) Prior Publication Data

US 2021/0183306 A1 Jun. 17, 2021

(30) Foreign Application Priority Data

Aug. 25, 2017 (CN) ..... 201710743300.2

(51) Int. Cl.
*G09G 3/3225* (2016.01)

(52) U.S. Cl.
CPC ..... *G09G 3/3225* (2013.01); *G09G 2320/046* (2013.01)

(58) Field of Classification Search
CPC ..... G09G 3/006; G09G 3/30–3291; G09G 2320/043–048
See application file for complete search history.

(56) References Cited

U.S. PATENT DOCUMENTS 6,137,303 A * 10/2000 Deckert ..... G01R 31/2831 324/757.03
2004/0085307 A1 5/2004 Moon
2014/0320136 A1* 10/2014 Cho ..... G09G 3/006 324/414

FOREIGN PATENT DOCUMENTS

CN 101153886 A 4/2008
CN 201111843 Y 9/2008
(Continued)

OTHER PUBLICATIONS

International Search Report and Written Opinon dated Jul. 9, 2018; PCT/CN2018/083546.

*Primary Examiner* — Hang Lin

(57) ABSTRACT

An aging device for a display panel includes: a bearing device, including a bearing surface that is configured to bear the display panel; a fixture, including a plurality of pins which are configured to provide a screen turning-on signal for the display panel; a first electrode and a second electrode, wherein the first electrode and the second electrode are in an opposite arrangement and configured to apply an electric field to the display panel. The aging device achieves aging by providing an electric field for the display panel, avoids the burning of the thin film transistor devices of the display panel caused by the excessive bias and allows the thin film transistors at different positions to be uniformly aged, and is also easy to operate and implement.

18 Claims, 4 Drawing Sheets

(56) References Cited

FOREIGN PATENT DOCUMENTS

| | | | |
|---|---|---|---|
| CN | 104122495 | A | 10/2014 |
| CN | 107424562 | A | 12/2017 |
| JP | 2001-330816 | A | 11/2001 |

* cited by examiner

AGING DEVICE AND AGING METHOD

TECHNICAL FIELD

Embodiments of the present disclosure relate to an aging device and an aging method.

BACKGROUND

Flat display panels have become the mainstream products in current display panels due to the advantages such as light weight, portability, low power consumption and so on, and include such as organic light-emitting diode (OLED) display panels, liquid crystal display (LCD) panels and the like. For example, most of OLED display panels are active matrix (AM) type display panels, which use thin-film transistors (TFTs) and capacitors to drive OLEDs to emit light. An active matrix display panel needs to be aged in the manufacturing process to stabilize the TFT performance so as to allow the luminance of the OLED to be stable.

SUMMARY

Embodiments of the present disclosure provide an aging device for a display panel, comprising: a bearing device, comprising a bearing surface that is configured to bear the display panel; a fixture, comprising a plurality of pins, which are configured to provide screen turning-on signals for the display panel; a first electrode and a second electrode, wherein the first electrode and the second electrode are in an opposite arrangement and configured to apply an electric field to the display panel.

In another aspect, embodiments of the present disclosure further provide an aging method of a display panel, comprising: placing the display panel on the bearing device, and electrically connecting a connection point of the display panel with the plurality of pins of the fixture; forming an electric field between the first electrode and the second electrode to act on the display panel; and applying screen turning-on signals to the display panel through the plurality of pins, so as to turn on the display panel.

BRIEF DESCRIPTION OF THE DRAWINGS

In order to clearly illustrate the technical solutions of the embodiments of the disclosure, the drawings of the embodiments will be briefly described in the following. It is obvious that the described drawings are only related to some embodiments of the disclosure and thus are not limitative of the disclosure.

DETAILED DESCRIPTION

Figure 1:
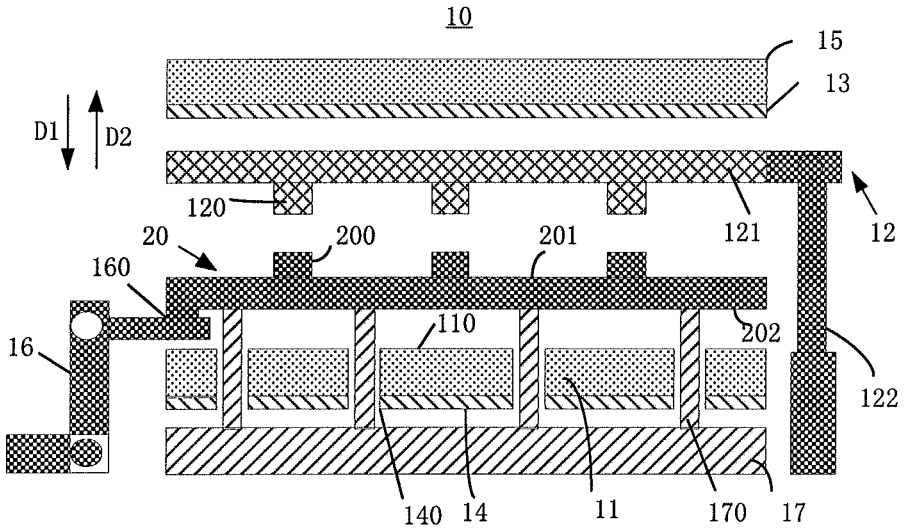
FIG. 1 is a structure schematic diagram of an aging device for a flat display panel provided by a first embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

When the manufacturing process of an active matrix display panel is completed, due to the influence of various factors such as process conditions, materials used, etc., movable stray electric charges exist inside the TFT device which acts as a driving component or a switch component, especially inside the active layer, and they can cause the electric leakage and tail-up phenomenon of the TFT, affecting the display quality of the display panel. Therefore, it is necessary to conduct the aging process to the display panel to adjust the stray electric charges inside the device, so as to alleviate the electric leakage and tail-up phenomenon of the TFT device.

An aging method of a display panel with TFT devices comprises applying a large gate bias to the TFT devices during the process of turning on the display panel, but this method is easy to burn the TFT devices, and also because of different voltage drops and manufacturing processes which are caused by different positions of the TFT devices, different materials used and the like, it is difficult to obtain a uniform aging effect all over the display panel, which still causes uneven luminescence of the display panel.

Embodiments of the present disclosure provide an aging device for a display panel and an aging method, and the aging device assists in achieving aging effect by providing an applied electric field for the display panel, which avoids the excessive bias burning TFT devices and allows the TFT devices at different positions to be uniformly aged, also easy to operate and to be implemented. The aging device and the aging method can be used for a flat display panel, a curved display panel and the like.

First Embodiment

Referring to FIG. 1, FIG. 1 is a structure schematic diagram of an aging device 10 for a flat display panel provided by a first embodiment of the present disclosure. The aging device 10 comprises a bearing device 11, a fixture 12, a first electrode 13 and a second electrode 14. The bearing device 11 comprises a bearing surface 110, such as a bearing platform, which is configured to bear a flat display panel 20 that is to be aged. The fixture 12 comprises a plurality of pins 120, which are configured to provide screen turning-on signals (e.g., comprising a scanning signal, a data signal, etc.) for aging the flat display panel 20. The first electrode 13 and the second electrode 14 are in an opposite arrangement and configured to provide an electric field for the flat display panel 20, and in this way the electric field is provided perpendicular to the plane in which the flat display panel 20 to be aged is provided.

In the figure, the direction from the first electrode 13 to the second electrode 14 is defined as a first direction DE and the opposite direction of the first direction D1 is defined as a second direction D2.

For example, the fixture 12 can comprise a plurality of pin plates 121, and the plurality of pins 120 are sequentially disposed on the pin plates 121.

For example, the fixture 12 can further comprise a lifting device 122, and the lifting device 122 is connected with the pin plate 121 and controls the movement of the pin plate 121 in the first direction and the second direction, such as a lifting movement.

For example, the first electrode 13, the pin plate 121, the bearing surface 110 and the second electrode 14 are sequentially disposed in the first direction, and are parallel to each other.

For example, the first electrode 13 is provided on a substrate 15. The substrate 15, for example, is a flat plate, and for example made of an insulating material, and the insulating material, for example, can be plastic, ceramic and so on.

For example, the second electrode 14 is on a surface of the bearing device 11, which surface is opposite to the bearing surface 110.

Figure 2A:
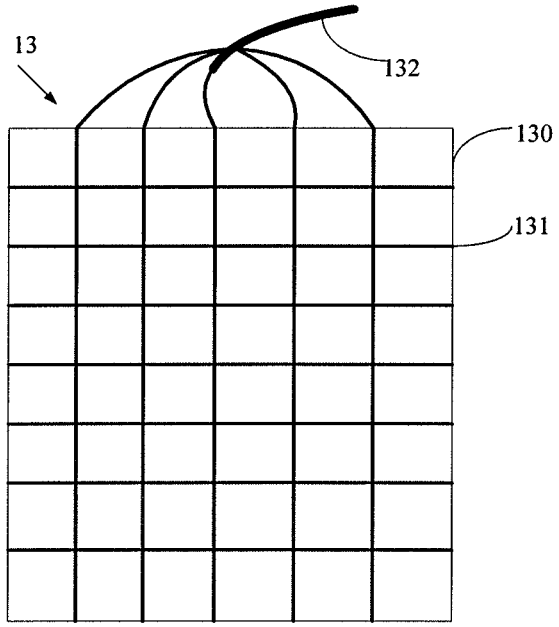
FIG. 2A is a structure schematic diagram of a first electrode provided by the first embodiment of the present disclosure.
Figure 2B:
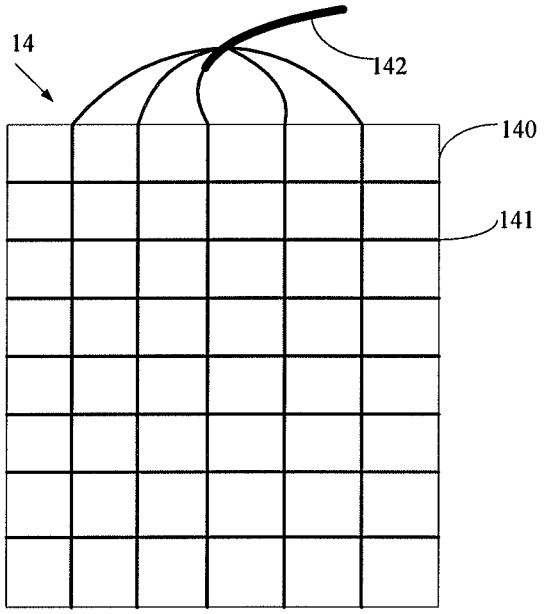
FIG. 2B is a structure schematic diagram of a second electrode provided by the first embodiment of the present disclosure.

For example, as illustrated in FIG. 2A, the first electrode 13, for example, is a plate electrode, and for example, comprises a first block electrode 130 and a mesh electrode line 131 on the first block electrode 130, and the mesh electrode line 131 is parallel connected with the first block electrode 130 and is connected with a first power supply (not shown) through a lead line 132; as illustrated in FIG. 2B, the second electrode 14, for example, is a plate electrode, and the structure of the second electrode 14 can be the same as the first electrode 13, for example, comprising a second block electrode 140 and a mesh electrode line 141 on the second block electrode 140, and the mesh electrode line 141 is parallel connected with the second block electrode 140 and is connected with a second power supply (not shown) through a lead line 142. Here the first power supply and the second power supply are provided with different voltages, so that after the voltages are applied to the first electrode 13 and the second electrode 14 respectively, an electric field can be formed between the first electrode 13 and the second electrode 14.

For example, the aging device 10 can further comprise a mechanical arm 16, and a pick-up device is provided on the mechanical arm 16 and is configured to pick up the flat display panel 20 that is to be aged and place the flat display panel 20 on the bearing surface 110, or remove the flat display panel 20 from the bearing surface 110. An example of the pick-up device comprises a vacuum pick-up device, such as a plurality of vacuum chucks 160.

For example, the aging device 10 can further comprise a support plate 17, the support plate 17 is on a side of the bearing device 11 away from the bearing surface 110 (such as the lower side in the figure), a plurality of support pillars 170 are provided on the support plate 17, a plurality of through holes 140 are in the bearing device 11 and the second electrode 14 at the positions corresponding to the plurality of support pillars 170, and the plurality of support pillars 170 can move along the plurality of through holes 140 in the first direction or the second direction, so as to allow the flat display panel 20 that is to be aged to be lift lower or higher when the flat display panel 20 is placed on the top of the support pillars 170, The top of the support pillars 170 can comprise a buffer section such as a rubber. The aging device 10 can further comprise a driving device (not shown), which is configured to control the movement of the support pillars 170, and the driving device, for example, can be a mechanical driving device, a pneumatic driving device or a hydraulic driving device; for example, the mechanical driving device can comprise a stepper motor, a screw and so on.

Figure 3:
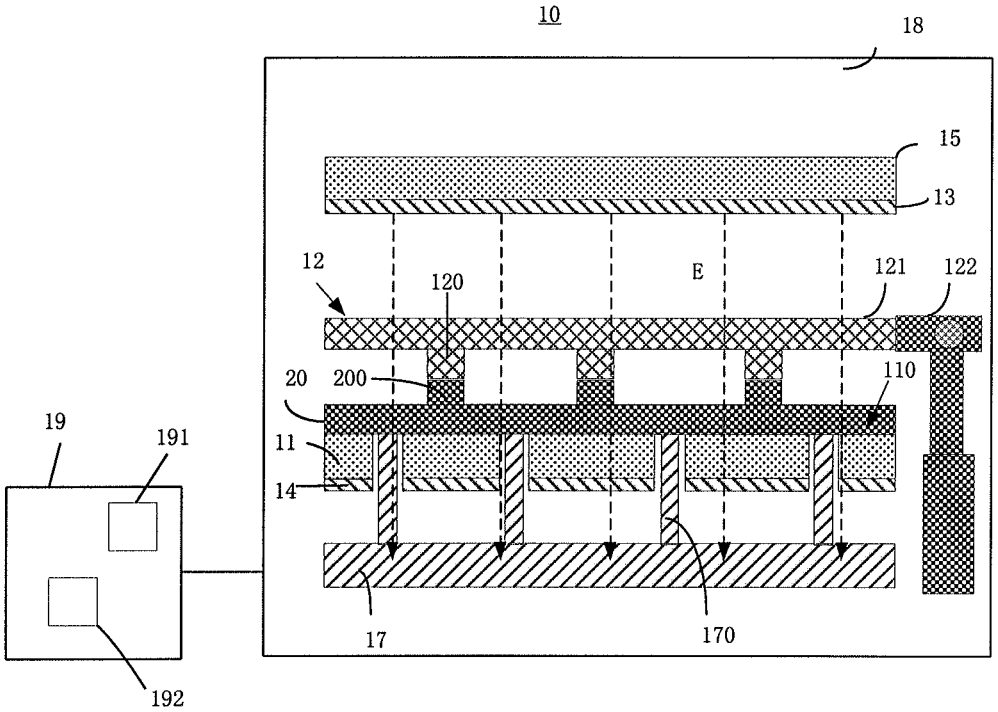
FIG. 3 is a structure schematic diagram of an aging device provided by the first embodiment of the present disclosure in operation.

FIG. 3 is a structure schematic diagram of an operating aging device provided by the first embodiment of the present disclosure; when different voltages are applied across the first electrode 13 and the second electrode 14 through the first power supply and the second power supply, so that an electric field is generated between the first electrode 13 and the second electrode 14, and the electric field acts on the flat display panel 20 that is to be aged and placed between the first electrode 13 and the second electrode 14.

For example, the aging device 10 can further comprise a cavity 18, and the bearing device 11, the fixture 12, the first electrode 13 and the second electrode 14 are all disposed inside the cavity 18. The cavity 18 can be in various suitable shapes, comprising side walls, a top ceiling and the like to define an enclosed space, and side walls and the like can be made of a suitable material, such as plastic, glass, metal, etc. If necessary, a transparent window can be further provided for the operator to observe the circumstance inside the cavity 18.

For example, the aging device 10 can further comprise a control device 19, a signal source 191 and a power supply 192. The signal source 191 is in signal connection with the fixture 12, and the control device 19 is configured to control the signal source 191 to provide the screen turning-on signals for the flat display panel 20 that is to be aged through the fixture 12; the power supply 192 is electrically connected with the first electrode 13 and the second electrode 14 respectively, and the control device 19 is configured to apply a voltage across the first electrode 13 and the second electrode 14 through the power supply 192.

For example, the control device 19 can comprise a processor and a memory, and the processor, for example, is a central processing unit (CPU) or other form of the processing unit with the data processing capability and/or instruction execution capability. For example, the processor can be implemented as a general purpose processor, and also can be a microcontroller, a microprocessor, a digital signal processor, a dedicated graphics processing, chip, a field programmable logic array or the like. The memory, for example, can comprise a random access memory and/or a non-volatile memory, and for example, can comprise a read-only memory (ROM), a hard disk drive, a flash memory and the like. Accordingly, the memory can be implemented as one or more computer program products, and the computer program product can comprise various forms of the computer readable storage medium in which one or more computer program instructions can be stored. The processor can run the program instructions to implement the function of the control device provided by the embodiments of the present disclosure and/or other desired functions. For example, the control device 19 can control the lifting device 122, thereby controlling the lifting movement of the pin plate 121, and also can control the lifting movement of the support plate 17, the open and the closure of the cavity 18, and the like.

For example, device wirings are formed on a side of the flat display panel 20, the side can be referred to as a pattern surface 201 and comprises a plurality of connection points 200, and the plurality of connection points 200 correspond to the plurality of pins 120 in one-to-one relationship for receiving the screen turning-on signals provided by the fixture 12. The plurality of pins 120 are on a side of the pin plate 121 near the bearing surface 110, and the plurality of connection points 200 are on a side of the flat display panel 20, which side is towards the pin plate 121.

Figure 4:
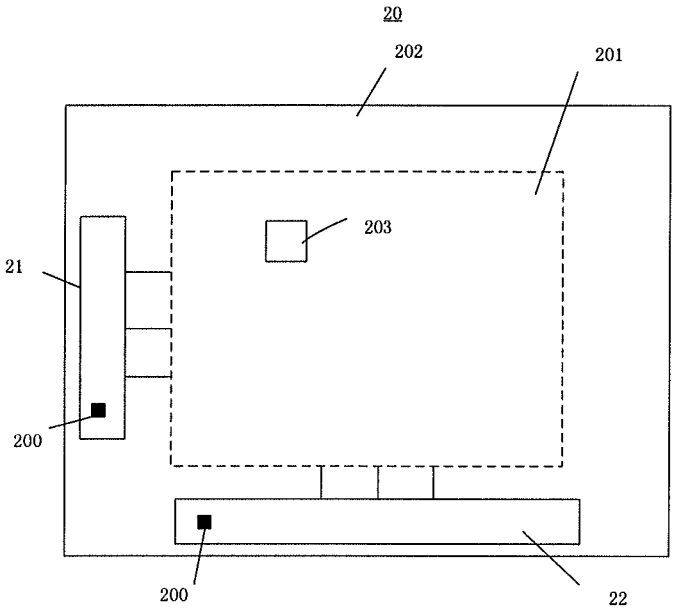
FIG. 4 is a structure schematic diagram of a display panel provided by the first embodiment of the present disclosure.

For example, the flat display panel 20 is an OLED display panel. Referring to FIG. 4, the OLED display panel comprises a display area 201 and a non-display area 202, and the display area 201 is provided with a plurality of OLED pixel units 203, a plurality of gate lines (also referred to as scanning lines or address lines) and a plurality of data lines (also referred to as signal lines) (not shown in the figure). Each pixel unit 203 comprises an organic light-emitting diode and a pixel circuit. Each pixel circuit comprises a plurality of TFTs, a storage capacitor, and the like.

The gate lines are driven by a gate driving circuit 21 (also referred to as a row driving circuit or a scanning driving circuit), and the data lines are driven by a data driving circuit 22 (also referred to as a column driving circuit). For example, the gate driving circuit 21 and the data driving circuit 22 can comprise a plurality of TFTs.

For example, in order to simplify the process and reduce the material cost, the gate driving circuit 21 can be directly integrated in the non-display area 202 of the OLED display panel 20 to form a gate-driver-on-array (GOA) structure.

For example, the plurality of connection points 200 of the flat display panel 20 comprise an input of the gate driving circuit 21 and an input of the data driving circuit 22. The screen turning-on signals comprise a gate signal Vgs, a data signal Vds and the like.

For example, the screen turning-on signals can further comprise a high level signal Vdd and a low level signal Vss (e.g., a grounded signal).

Figure 5:
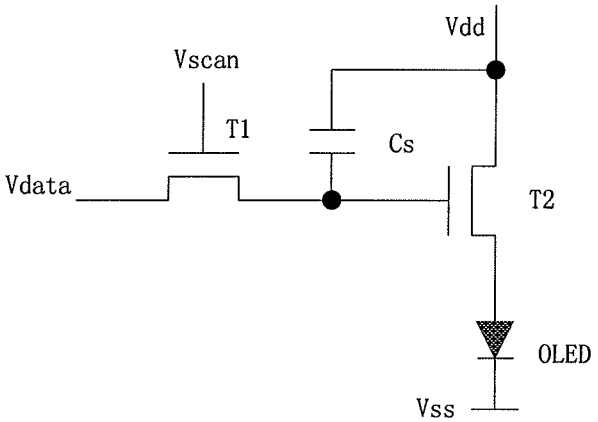
FIG. 5 is a schematic diagram of a 2T1C pixel circuit of a display panel provided by the first embodiment of the present disclosure.

FIG. 5 is a schematic diagram of a 2T1C pixel circuit of the OLED display panel provided by the embodiment. The 2T1C pixel circuit comprises a switch transistor T1, a driving transistor T2 and a storage capacitor Cs. A gate electrode of the switch transistor T1 is connected with a gate line to receive a scanning signal (Scan), for example, a source electrode of the switch transistor T1 is connected with the data line to receive a data signal (Vdata), and a drain electrode of the switch transistor T1 is connected with a gate electrode of the driving transistor T2; a source electrode of the driving transistor T2 is connected with a first power supply terminal (Vdd, a high voltage terminal), and a drain electrode of driving transistor T2 is connected with an anode terminal of the OLED; one end of the storage capacitor Cs is connected with the drain electrode of the switch transistor T1 and the gate electrode of the driving transistor T2, and another end of the storage capacitor Cs is connected with the source electrode of the driving transistor T2 and the first power supply terminal; a cathode of the OLED is connected with a second power supply terminal (Vss, a low voltage terminal), such as grounded. The driving method of the 2T1C pixel circuit is to allow the brightness and the darkness (gray scale) of the pixel to be controlled through two TFTs and the storage capacitor Cs. When the scanning signal Scan is applied through the gate line to turn on the switch transistor T1, the data voltage (Vdata) transmitted by the data driving circuit through the data line charges the storage capacitor Cs via the switch transistor T1, so as to store the data voltage in the storage capacitor Cs, and the stored data voltage controls the conduction degree of the driving transistor T2, so as to control the magnitude of the current that flows through the driving transistor T2 to drive the OLED to emit light, that is, the current determines the gray scale of the pixel illumination. In the 2T1C pixel circuit illustrated in FIG. 5, the switch transistor T1 and the driving transistor T2 can be an N-type transistor or a P-type transistor as needed, and for example, the switch transistor T1 and the driving transistor T2 are both N-type transistors, or the switch transistor T1 is an N-type transistor while the driving transistor T2 is a P-type transistor.

For example, on the basis of the above 2T1C pixel circuit or other 2T1C pixel circuits, in order to compensate for such as the threshold shift of the driving transistor T2, the voltage drop caused by the power line resistance, etc., the pixel circuit can further comprise a compensation circuit, and the compensation circuit comprises an internal compensation circuit or an external compensation circuit, the compensation circuit comprising a transistor, a capacitor and the like. In addition, as needed, the pixel driving circuit can further comprise a reset circuit, a sensing circuit and the like, so as to obtain the configuration of 3T1C, 4T2C or the like. This aspect is not limited in the embodiments of the present disclosure.

In the following, an aging method of the aging device 10 provided by the first embodiment of the present disclosure will be described in connection with FIG. 1 and FIG. 3.

The flat display panel 20 is placed on the bearing device 11, and electrically the connection points 200 of the flat display panel 20 are connected with the plurality of pins 120 of the fixture 12; an electric field is generated between the first electrode 13 and the second electrode 14 and acts on the flat display panel 20; and screen turning-on signals are applied to the flat display panel 20 through the plurality of pins 120 so as to turn on the flat display panel 20.

For example, at the beginning of the aging process, the cavity 18 is opened, and the vacuum chucks 160 of the mechanical arm 16 pick up the flat display panel 20 and are ready to send the flat display panel 20 into the cavity 18.

The vacuum chucks 160 of the mechanical arm 16 face away from the bearing surface 110 and act on a side 202 of the flat display panel 20, which side is opposite to the pattern surface 201, so as to avoid damaging the device wirings formed on the pattern surface 201. The plurality of connection points 200 on the flat display panel 20 face away from the bearing surface 110 towards the pin plate 121.

As illustrated in FIG. 1, before the mechanical arm 16 places the flat display panel 20 on the bearing surface 110, the support plate 17 moves close to the bearing device 11 in the second direction, and drives the support pillars 170 to move along the through holes 140 and to extend out of the bearing surface 110. The height of the support pillars 170 extending out of the bearing surface 110 is enough to accommodate the portion of the mechanical arm 16 that extends over the bearing surface 110, so as to allow the mechanical arm 16 to place the flat display panel 20 on the plurality of support pillars 170.

As illustrated in FIG. 3, the support plate 17 moves away from the bearing device 11 in the first direction, and drives the support pillars 170 to move along the through holes 140 and to move in the first direction until below the bearing surface 110, so as to allow the flat display panel 20 to be placed on the bearing surface 110.

Under the control of the lifting device 122, the pin plate 121 moves close to the flat display panel 20 in the first direction and contacts the flat display panel 20, and the plurality of pins 120 on the pin plate 121 contact the plurality of the connection points 200 on the flat display panel 20 and establish an electrical connection.

The cavity 18 is closed and the power supply 192 is turned on, so as to allow an electric field E to be generated between the first electrode 13 and the second electrode 14 to age the flat display panel 20.

The embodiments of the present disclosure use an externally formed electric field instead of a large gate voltage to age a TFT device, so as to adjust the stray electric charges inside the TFT device and alleviate the electric leakage and tail-up phenomenon of the TFT. The external electric field direction comprises a first direction D1 and a second direction D2. For example, the TFT comprises a top gate structure and/or a bottom gate structure; the gate electrode of the TFT with the top gate structure is closer to the substrate than the active layer, and the gate electrode of the TFT with the bottom gate structure is farther away from the substrate than the active layer. The TFTs with different structures require the aging electric fields in different directions according to the type of the stray electric charges.

Figure 6:
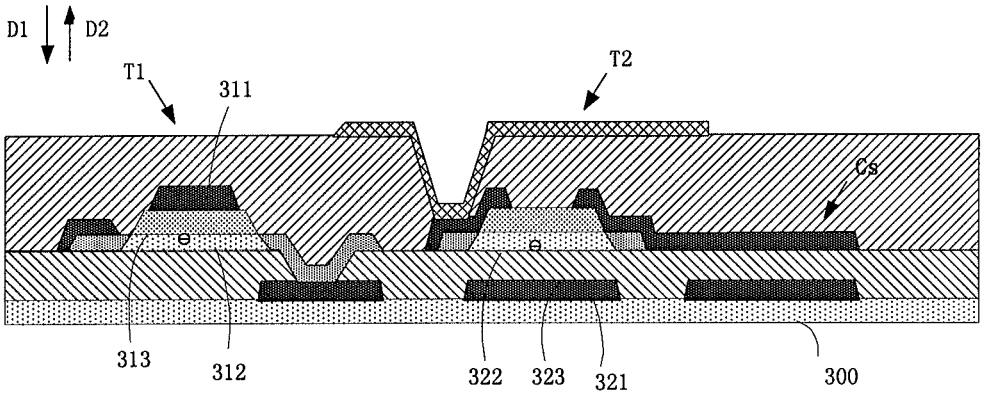
FIG. 6 is a partial structure schematic diagram of the pixel circuit illustrated in FIG. 5.

Please refer to FIG. 6. FIG. 6 is a partial structure schematic diagram corresponding to the pixel circuit illustrated in FIG. 5, but the embodiments of the present disclosure is not limited to the specific structure. The circuit comprises the switch transistor T1, the driving transistor T2 and the capacitor Cs. The switch transistor T1 is with a top gate structure, and a gate electrode 311 of the switch transistor T1 is farther away from a substrate 300 than an active layer 312. The driving transistor T2 is with a bottom gate structure, and a gate electrode 321 of the driving transistor T2 is closer to the substrate 300 than an active layer 322. The switch transistor T1 and the driving transistor T2 are both enhancement N-type TFTs. For example, due to the reasons of the manufacturing process, the material and so on, negative stray electric charges may occur in the channel region of the active layer 312 of the switch transistor T1 that is close to a gate insulating layer 313 and in the channel region of the active layer 322 of the driving transistor T2 that is close to a gate insulating layer 323. These stray electric charges can cause the electric leakage and tail-up phenomenon of the thin film transistor and influence the performance of the thin film transistor, therefore, the driving circuit needs to be aged to allow the stray electric charges to move to the body region of the active layer away from the channel region. For the switch transistor T1, it is necessary to apply an electric field in the second direction D2 for aging, and for the driving transistor T2, it is necessary to apply an electric field in the first direction D1 for aging.

Therefore, the direction of the aging electric field needs to involve the first direction D1 and the second direction D2, so as to allow each of the TFTs to be aged. First, the operation of generating the electric field E between the first electrode 13 and the second electrode 14 comprises: an electric field generated between the first electrode 13 and the second electrode 14 in the first direction D1, and with the direction of the electric field being changed after a period of time, an electric field to be generated between the first electrode 13 and the second electrode 14 in the second direction.

The signal source 191 is switched on, and screen turning-on signals are provided for the flat display panel 20 through the fixture 12. With observing of the turning-on condition of the device, if the luminescence of the flat display panel 20 is uneven, the amplitude of the electric field can be adjusted.

For example, the amplitude of the electric field can be changed by changing the distance between the first electrode 13 and the second electrode 14, or by changing the position of the flat display panel 20 between the first electrode 13 and the second electrode 14.

The embodiments of the present disclosure achieve aging by providing an electric field for the flat display panel 20, which avoids the burning of the TFT device caused by the excessive bias and allows the TFTs at different positions to be uniformly aged, also easy to operate and implement.

Second Embodiment

Figure 7:
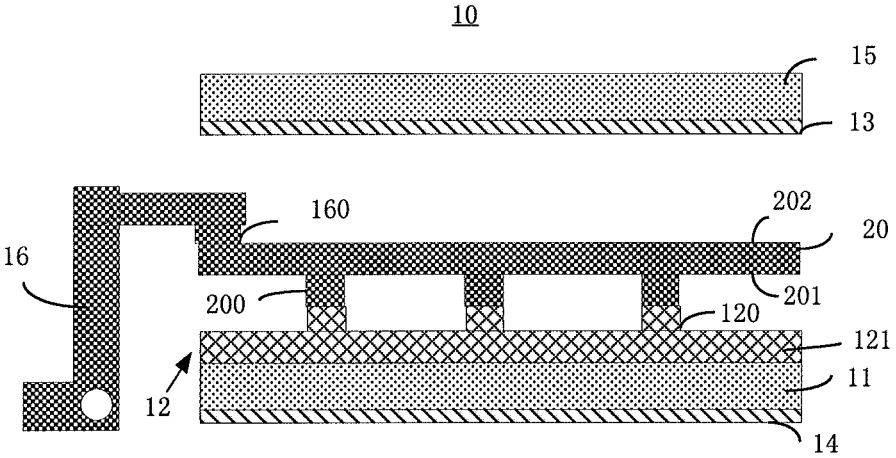
FIG. 7 is a structure schematic diagram of an aging device for a flat display panel provided by a second embodiment of the present disclosure.

Please refer to FIG. 7. FIG. 7 is a structure schematic diagram of an aging device 10 for a flat display device provided by the second embodiment of the present disclosure. The aging device of the second embodiment has substantially the same structure as the aging device of the first embodiment, except for the structure of the fixture 12 and the position of the fixture 12 as well as the position relationship between the flat display panel 20 and the fixture 12 during aging. The present embodiment does not require a support plate. For convenience of description, the present embodiment uses the same reference numerals to denote the components which are the same as those of the first embodiment, and it will not be described in detail in the following.

As illustrated in FIG. 7, the pin plate 121 of the fixture 12 is fixedly disposed on the bearing surface 110 and does not require the lifting device to control the movement of the pin plate 121. The plurality of pins 120 are on a side of the pin plate 121, which side is away from the bearing device 11.

The aging method of applying the aging device provided by the second embodiment for aging the flat display device is substantially the same as the aging method of applying the aging device provided by the first embodiment for aging the flat display device, and the differences mainly comprise the following.

As illustrated in FIG. 7, at the beginning of the aging process, when the vacuum chucks 160 of the mechanical arm 16 pick up the flat display panel 20 and are ready to send the flat display panel 20 into the cavity 18, the pattern surface 201 of the flat display panel 20 faces the bearing surface 110, and the vacuum chucks 160 of the mechanical arm 16 act on the side 202 opposite to the pattern surface 201, so as to avoid damaging the device lines formed on the pattern surface 201.

The mechanical arm 16 places the flat display panel 20 on the surface of the pin plate 121, and the plurality of connection points 200 on the flat display panel 20 directly contact the plurality of pins 120 on the pin plate 121 and establish an electrical connection.

The vacuum chucks 160 of the mechanical arm 16 face the bearing surface 110 and act on the side 202 of the flat display panel 20 opposite the pattern surface 201, so as to avoid damaging the device lines formed on the pattern surface 201. The plurality of connection points 200 on the flat display panel 20 face the bearing surface 110 and are connected with the pin plate 121.

The embodiments of the present disclosure achieve aging by providing an electric field for the flat display panel 20, which avoids the burning of the TFT device caused by the excessive bias and allows the TFTs at different positions to be uniformly aged, also easy to operate and implement.

Although the above embodiments are described by taking the display panel to be aged as a flat display panel as an example, those skilled in the art should understand that the aging device provided by the embodiments of the present disclosure can also be used for a curved display panel. For example, according to the shape, the degree of curve (such as the radius of curvature) and the like of the curved display panel to be aged, adaptive changes to the aging device described above can be made, such as adaptive changes to the bearing surface and the fixture, and then the aging method described above can be used to age the curved display panel.

What have been described above are only specific implementations of the present disclosure, the protection scope of the present disclosure is not limited thereto, and the protection scope of the present disclosure should be based on the protection scope of the claims.

The application claims priority to the Chinese patent application No. 201710743300.2, filed on Aug. 25, 2017, the entire disclosure of which is incorporated herein by reference as part of the present application.

What is claimed is:

1. An aging device for a display panel, comprising:

a bearing device, comprising a bearing surface that is configured to bear the display panel;

a fixture, comprising a plurality of pins, which are configured to provide screen turning-on signals for the display panel; and a first electrode and a second electrode, wherein the first electrode and the second electrode are in an opposite arrangement and configured to apply an electric field to the display panel, wherein the first electrode comprises a first block electrode and a first mesh electrode line on the first block electrode, and the first mesh electrode line is parallel connected with the first block electrode; and the second electrode comprises a second block electrode and a second mesh electrode line provided on the second block electrode, and the second mesh electrode line is parallel connected with the second block electrode.

2. The aging device according to claim 1, wherein the first electrode is independent of the bearing device, and the second electrode is on the bearing device.

3. The aging device according to claim 1, wherein the fixture comprises a pin plate, and the plurality of pins are on the pin plate.

4. The aging device according to claim 3, wherein the pin plate is on the bearing surface of the bearing device, and the plurality of pins of the pin plate are on a side of the pin plate away from the bearing device.

5. The aging device according to claim 3, wherein the fixture further comprises a lifting device connected with the pin plate, and the pin plate is capable of moving under control of the lifting device in a direction perpendicular to the bearing device; and the pin plate is on a side of the bearing surface away from the bearing device, and the plurality of pins of the pin plate are on a side of the pin plate near the bearing device.

6. The aging device according to claim 5, further comprising a support plate, wherein the support plate is on a side of the bearing device away from the pin plate, the support plate comprises a plurality of support pillars, the bearing device is provided with a plurality of through holes corresponding to the plurality of support pillars, and the plurality of support pillars are able to rise or fall along the plurality of through holes.

7. The aging device according to claim 1, further comprising a mechanical arm, wherein the mechanical arm is configured to pick up the display panel and place the display panel on the bearing device, or remove the display panel from the bearing device.

8. The aging device according to claim 1, further comprising a cavity, wherein the bearing device, the fixture, the first electrode and the second electrode are inside the cavity.

9. The aging device according to claim 1, further comprising a control device, a signal source and a power supply, wherein the control device is configured to provide the screen turning-on signals for the display panel through the signal source and the plurality of pins, and to apply a voltage across the first electrode and the second electrode through the power supply.

10. The aging device according to claim 1, wherein the display panel is an organic light-emitting diode display panel.

11. An aging method of a display panel, applicable for the aging device according to claim 1, comprising:

placing the display panel on the bearing device, and electrically connecting a connection point of the display panel with the plurality of pins of the fixture;

forming an electric field between the first electrode and the second electrode to act on the display panel; and applying the screen turning-on signals to the display panel through the plurality of pins, so as to turn on the display panel.

12. The aging method according to claim 11, wherein an amplitude of the electric field is changed, and the screen turning-on signals are applied to the display panel so as to allow the display panel to emit light uniformly.

13. The aging method according to claim 12, wherein changing the amplitude of the electric field comprises:

changing a distance between the first electrode and the second electrode, or changing a position of the display panel between the first electrode and the second electrode.

14. The aging method according to claim 11, wherein forming the electric field between the first electrode and the second electrode comprises:

forming an electric field in a first direction between the first electrode and the second electrode; and forming an electric field in a second direction between the first electrode and the second electrode, wherein the first direction is opposite to the second direction.

15. The aging device according to claim 1, wherein the fixture comprises a pin plate, and the plurality of pins are on the pin plate.

16. The aging device according to claim 15, wherein the pin plate is on the bearing surface of the bearing device, and the plurality of pins of the pin plate are on a side of the pin plate away from the bearing device.

17. The aging device according to claim 15, wherein the fixture further comprises a lifting device connected with the pin plate, and the pin plate is capable of moving under control of the lifting device in a direction perpendicular to the bearing device; and the pin plate is on a side of the bearing surface away from the bearing device, and the plurality of pins of the pin plate are on a side of the pin plate near the bearing device.

18. The aging device according to claim 17, further comprising a support plate, wherein the support plate is on a side of the bearing device away from the pin plate, the support plate comprises a plurality of support pillars, the bearing device is provided with a plurality of through holes corresponding to the plurality of support pillars, and the plurality of support pillars are able to rise or fall along the plurality of through holes.

* * * * *